US008235836B2

(12) United States Patent
Soracco et al.

(10) Patent No.: US 8,235,836 B2
(45) **Date of Patent: *Aug. 7, 2012**

(54) INTERCHANGEABLE SHAFT SYSTEM

(75) Inventors: Peter L. Soracco, Carlsbad, CA (US); Thomas C. Morris, Carlsbad, CA (US); Scott A. Rice, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/012,479

(22) Filed: Jan. 24, 2011

(65) Prior Publication Data

US 2011/0118048 A1 May 19, 2011

Related U.S. Application Data

(63) Continuation of application No. 12/336,748, filed on Dec. 17, 2008, now Pat. No. 7,874,934, which is a continuation-in-part of application No. 12/023,402, filed on Jan. 31, 2008, now Pat. No. 7,699,717.

(51) Int. Cl.
*A63B 53/02* (2006.01)

(52) U.S. Cl. ..... 473/307; 473/309

(58) Field of Classification Search ..... 473/288, 473/307, 309–310, 296–299

See application file for complete search history.

(56) References Cited

U.S. PATENT DOCUMENTS

| | | | |
|---|---|---|---|
| 2,020,679 | A | 11/1935 | Fitzpatrick |
| 2,027,452 | A | 1/1936 | Rusing |
| 2,051,961 | A | 8/1936 | Mears |
| 2,067,556 | A | 1/1937 | Wettlaufer |
| 2,219,670 | A | 10/1940 | Wettlaufer |
| 2,326,495 | A | 8/1943 | Reenstierna |
| 2,361,415 | A | 10/1944 | Reach |
| 2,962,286 | A | 11/1960 | Brouwer |
| 3,170,691 | A | 2/1965 | Pritchard |
| 3,524,646 | A | 8/1970 | Wheeler |
| 3,595,577 | A | 7/1971 | Hodge |
| 3,625,517 | A | 12/1971 | Durnack |
| 3,685,135 | A | 8/1972 | Letters |
| 3,810,631 | A | 5/1974 | Braly |
| 3,840,231 | A | 10/1974 | Moore |
| 4,222,567 | A | 9/1980 | Shabala |
| 4,664,382 | A | 5/1987 | Palmer et al. |
| 4,852,782 | A | 8/1989 | Wu et al. |
| 4,854,582 | A | 8/1989 | Yamada |
| 4,943,059 | A | 7/1990 | Morell |
| 4,948,132 | A | 8/1990 | Wharton |
| 5,039,098 | A | 8/1991 | Pelz |
| 5,058,891 | A | 10/1991 | Takeuchi |
| 5,133,553 | A | 7/1992 | Divnick |
| 5,184,819 | A | 2/1993 | Desbiolles |

(Continued)

FOREIGN PATENT DOCUMENTS

| | | | |
|---|---|---|---|
| EP | 0535848 | A1 | 4/1993 |

(Continued)

*Primary Examiner* — Stephen L. Blau
(74) *Attorney, Agent, or Firm* — Michael J. Mancuso

(57) ABSTRACT

A golf club incorporating an interchangeable shaft system includes a shaft, a shaft sleeve, a club head. The shaft sleeve is coupled to an end of the shaft and is received in a hosel included in the club head. The shaft sleeve is removably coupled to the club head. Hosel and shaft sleeve alignment features provide discreet orientations between the shaft and club head.

9 Claims, 10 Drawing Sheets

U.S. PATENT DOCUMENTS

| | | | | |
|---|---|---|---|---|
| 5,433,442 | A | 7/1995 | Walker | |
| 5,527,034 | A | 6/1996 | Ashcraft et al. | |
| 5,722,901 | A | 3/1998 | Barron et al. | |
| 5,839,973 | A | 11/1998 | Jackson | |
| 5,851,155 | A | 12/1998 | Wood et al. | |
| 5,885,170 | A | 3/1999 | Takeda | |
| 5,899,511 | A * | 5/1999 | Dinatale | 294/19.2 |
| 5,951,411 | A | 9/1999 | Wood et al. | |
| 6,110,055 | A * | 8/2000 | Wilson | 473/239 |
| 6,183,375 | B1 | 2/2001 | Weiss | |
| 6,241,623 | B1 | 6/2001 | Laibangyang | |
| 6,251,028 | B1 | 6/2001 | Jackson | |
| 6,273,828 | B1 | 8/2001 | Wood et al. | |
| 6,341,690 | B1 | 1/2002 | Swiatosz | |
| 6,547,673 | B2 | 4/2003 | Roark | |
| 6,620,053 | B2 | 9/2003 | Tseng | |
| 6,634,958 | B1 | 10/2003 | Kusumoto | |
| 6,966,847 | B2 | 11/2005 | Lenhof et al. | |
| 6,981,922 | B2 | 1/2006 | Lenhof et al. | |
| 7,083,529 | B2 | 8/2006 | Cackett et al. | |
| 7,232,376 | B2 | 6/2007 | Droppleman | |
| 7,300,359 | B2 | 11/2007 | Hocknell et al. | |
| 7,651,407 | B2 | 1/2010 | Tsai et al. | |
| 7,704,158 | B2 | 4/2010 | Burrows | |
| 8,083,608 | B2 | 12/2011 | Thomas et al. | |
| 2001/0007835 | A1 | 7/2001 | Baron | |
| 2004/0018886 | A1 | 1/2004 | Burrows | |
| 2004/0018887 | A1 | 1/2004 | Burrows | |
| 2005/0181884 | A1 | 8/2005 | Beach et al. | |
| 2005/0282652 | A1 | 12/2005 | Brinton et al. | |
| 2006/0163093 | A1 | 7/2006 | Kronenberger | |
| 2006/0281575 | A1 | 12/2006 | Hocknell et al. | |
| 2006/0287125 | A1 | 12/2006 | Hocknell et al. | |
| 2006/0293115 | A1 | 12/2006 | Hocknell et al. | |
| 2008/0108455 | A1 | 5/2008 | Wu | |
| 2008/0119301 | A1 | 5/2008 | Holt et al. | |
| 2008/0280693 | A1 * | 11/2008 | Chai | 473/288 |
| 2009/0062029 | A1 | 3/2009 | Stites et al. | |
| 2009/0258723 | A1 | 10/2009 | Sato et al. | |
| 2010/0022323 | A1 | 1/2010 | Thomas et al. | |
| 2010/0035701 | A1 | 2/2010 | Kusumoto | |
| 2010/0041491 | A1 | 2/2010 | Thomas et al. | |
| 2010/0203981 | A1 | 8/2010 | Morris et al. | |
| 2010/0331121 | A1 | 12/2010 | Morris et al. | |
| 2011/0009206 | A1 | 1/2011 | Soracco | |

FOREIGN PATENT DOCUMENTS

| | | | |
|---|---|---|---|
| GB | 751323 | | 6/1956 |
| JP | 2008278951 | A * | 11/2008 |
| WO | WO 90/00424 | | 1/1990 |
| WO | WO 2009/032533 | | 3/2009 |
| WO | WO 2009/035345 | | 3/2009 |
| WO | WO 2010/011510 | | 1/2010 |

* cited by examiner

INTERCHANGEABLE SHAFT SYSTEM

CROSS-REFERENCE TO RELATED APPLICATIONS

This application is a continuation of U.S. patent application Ser. No. 12/336,748, filed Dec. 17, 2008, now U.S. Pat. No. 7,874,934, which is a continuation-in-part of U.S. patent application Ser. No. 12/023,402, filed Jan. 31, 2008, now U.S. Pat. No. 7,699,717, the contents of which are incorporated in their entireties by reference herein.

FIELD OF THE INVENTION

This invention generally relates to golf clubs, and more specifically to golf clubs having an improved connection between the shaft and club head that provides interchangeability.

BACKGROUND OF THE INVENTION

In order to improve their game, golfers often customize their equipment to fit their particular swing. In the absence of a convenient way to make shafts and club heads interchangeable, a store or a business offering custom fitting must either have a large number of clubs with specific characteristics, or must change a particular club using a complicated disassembly and reassembly process. If, for example, a golfer wants to try a golf club shaft with different flex characteristics, or use a club head with a different mass, center of gravity, or moment of inertia, in the past it has not been practical to make such changes. Golf equipment manufacturers have been increasing the variety of clubs available to golfers. For example, a particular model of golf club may be offered in several different loft angles and lie angles to suit a particular golfer's needs. In addition, golfers can choose shafts, whether metal or graphite, and adjust the length of the shaft to suit their swing. Recently, golf clubs have emerged that allow shaft and club head components, such as adjustable weights, to be interchanged to facilitate this customization process.

One example is U.S. Pat. No. 3,524,646 to Wheeler for a Golf Club Assembly. The Wheeler patent discloses a putter having a grip and a putter head, both of which are detachable from a shaft. Fastening members, provided on the upper and lower ends of the shaft, have internal threads, which engage the external threads provided on both the lower end of the grip and the upper end of the putter head shank to secure these components to the shaft. The lower portion of the shaft further includes a flange that contacts the upper end of the putter head shank when the putter head is coupled to the shaft. This design produces an unaesthetic bulge at the top of the shaft and another unaesthetic bulge at the bottom of the shaft.

Another example is U.S. Pat. No. 4,852,782 to Wu et al. for Equipment for Playing Golf. The Wu patent discloses a set of equipment for playing golf that includes a length adjustable shaft and a plurality of club heads that are designed for easy assembly and disassembly. A connecting rod is inserted into an end of the shaft and a pin retains the connecting rod within the shaft. A locking portion of the connecting rod is configured to extend into the neck of a club head and through a slot in the neck. After the locking portion is extended through the slot, the connecting rod is rotated relative to the club head so that the components are locked together. The neck also includes sloping end surfaces that are configured to guide the ends of the pin to adjacent stop surfaces during the relative rotation between the connecting rod and the club head.

Another example is U.S. Pat. No. 4,943,059 to Morell for a Golf Club Having Removable Head. The Morell patent discloses a putter golf club including a releasable golf club head and an elongated golf club shaft. The club head hosel has a plug containing a threaded axial bore. A threaded rod is retained on the connector portion of the shaft and is threaded into the axial bore of the plug of the club head for operatively connecting the shaft to the head.

Another example is U.S. Pat. No. 5,433,442 to Walker for Golf Clubs with Quick Release Heads. The Walker patent discloses a golf club in which the club head is secured to the shaft by a coupling rod and a quick release pin. The upper end of the coupling rod has external threads that engage the internal threads formed in the lower portion of the shaft. The lower end of the coupling rod, which is inserted into the hosel of the club head, has diametric apertures that align with diametric apertures in the hosel to receive the quick release pin.

Another example is U.S. Pat. No. 5,722,901 to Barron et al. for a Releasable Fastening Structure for Trial Golf Club Shafts and Heads. The Barron patent discloses a bayonet-style releasable fastening structure for a golf club and shaft. The club head hosel has a fastening pin in its bore that extends diametrically. The head portion of the shaft has two opposing "U" or "J" shaped channels. The head end portion of shaft fastens on the hosel pin through axial and rotary motion. A spring in the hosel maintains this fastenable interconnection, but allows manually generated, axially inward hosel motion for quick assembly and disassembly.

Another example is U.S. Pat. No. 5,951,411 to Wood et al. for a Hosel Coupling Assembly and Method of Using Same. The Wood patent discloses a golf club including a club head, an interchangeable shaft, and a hosel with an anti-rotation device. The hosel contains an alignment member with an angular surface that is fixed, by a stud, within the hosel bore. A sleeve secured on the shaft end forms another alignment arrangement element and is adapted to engage the alignment element disposed in the hosel bore. A capture mechanism disposed on the shaft engages the hosel to fix releasably the shaft relative to the club head.

Still another example is U.S. Pat. No. 6,547,673 to Roark for an Interchangeable Golf Club Head and Adjustable Handle System. The Roark patent discloses a golf club with a quick release for detaching a club head from a shaft. The quick release is a two-piece connector including a lower connector, which is secured to the hosel of the club head, and an upper connector, which is secured to the lower portion of the shaft. The upper connector has a pin and a ball catch that both protrude radially outward from the lower end of the upper connector. The upper end of the lower connector has a corresponding slot formed therein for receiving the upper connector pin, and a separate hole for receiving the ball catch. When the shaft is coupled to the club head, the lower connector hole retains the ball catch to secure the shaft to the club head.

Another example is U.S. Pat. No. 7,083,529 to Cackett et al. for a Golf Club with Interchangeable Head-Shaft Connections. The Cackett publication discloses a golf club that uses a sleeve/tube arrangement instead of a traditional hosel to connect the interchangeable shaft to the club head in an effort to reduce material weight and provide for quick installation. A mechanical fastener (screw) entering the club head through the sole plate is used to secure the shaft to the club head.

Another example is U.S. Pat. App. Publ. No. 2001/0007835 A1 to Baron for a Modular Golf Club System and Method. The Baron publication discloses a modular golf club including club head, hosel, and shaft. A hosel is attached to a shaft and rotation is prevented by complementary interacting surfaces, adhesive bonding or mechanical fit. The club head and shaft are removably joined together by a collet-type connection.

Other published patent documents, such as U.S. Pat. Nos. 7,300,359; 7,344,449; and 7,427,239 and U.S. Pat. App. Publ. No. 2006/0287125, disclose interchangeable shafts and club heads with anti-rotation devices located therebetween.

There remains a need in the art for golf clubs with an improved connection that provides a more secure fit and that is easier to manufacture.

SUMMARY OF THE INVENTION

The invention is directed to an interchangeable shaft system for a golf club. The inventive system provides interchangeability between a shaft and a club head that imparts minimal additional components and manufacturing difficulty. Several embodiments of the present invention are described below.

In one embodiment, a golf club incorporating the interchangeable shaft system of the present invention includes a club head, a shaft, a shaft sleeve, a weight member and a fastener. The club head includes a hosel and at least one hosel alignment feature disposed adjacent a proximal end of the shaft. The shaft sleeve is coupled to a distal end portion of the shaft. The shaft sleeve includes a sleeve body and at least one sleeve alignment feature that is shaped to complement the shape of the hosel alignment feature. At least a portion of the shaft sleeve is received within a sleeve bore defined by the hosel and the sleeve alignment feature engages the hosel alignment feature. A fastener releasably couples the shaft sleeve to the club head.

In another embodiment, a golf club includes a club head including a hosel and a plurality of notches spaced circumferentially about a proximal end of the hosel and that extend at least partially through a sidewall of the hosel. A shaft sleeve is coupled to a distal end portion of an elongate shaft. The shaft sleeve includes a sleeve body and a plurality of tangs that extend laterally outward from the sleeve body. At least a portion of the shaft sleeve is received within a sleeve bore defined by the hosel and the tangs engage the notches. A weight member is coupled to the shaft sleeve and a fastener releasably couples the shaft sleeve to the club head.

In a further embodiment, a golf club includes a club head including a hosel and a plurality of hosel alignment features spaced circumferentially about a proximal end of the hosel. A shaft sleeve is coupled to a distal end portion of an elongate shaft and removably coupled to the club head. The shaft sleeve includes a sleeve body and at least one sleeve alignment feature that is shaped to engage at least one of the hosel alignment features. A weight member is coupled to the shaft sleeve. At least a portion of the shaft sleeve is received within a sleeve bore defined by the hosel.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1:
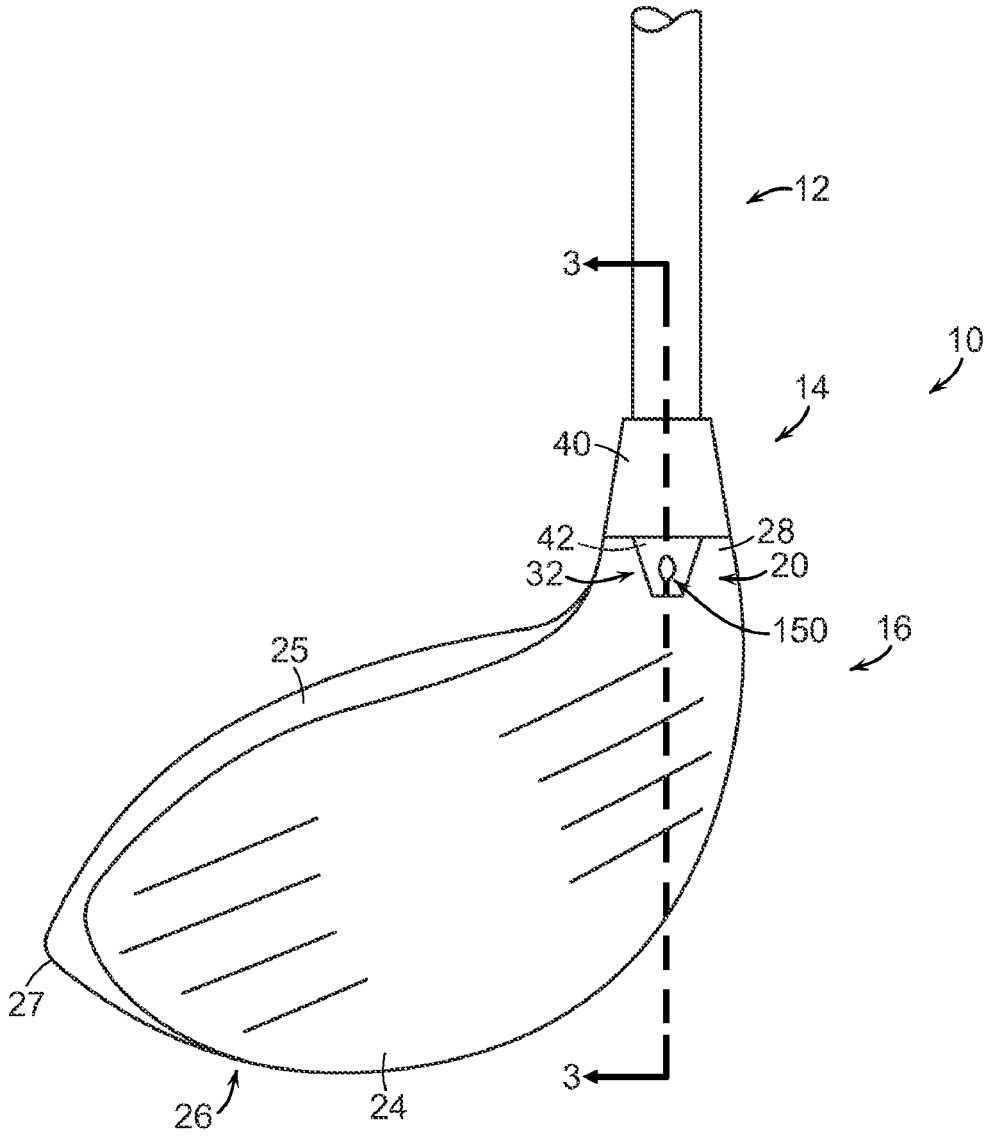
FIG. 1 is a side view of a portion of an exemplary golf club including an embodiment of the interchangeable shaft system of the present invention.

The present invention is directed to an interchangeable shaft system for connecting the shaft of a golf club to a club head. Such a system can be utilized to provide for customized fitting of various shaft types to a club head and/or to provide adjustability between a shaft and a club head. Several embodiments of the present invention are described below.

A golf club incorporating an interchangeable shaft system 10 of the present invention generally includes a shaft 12, a shaft sleeve 14, a club head 16 and a fastener 18. Interchangeable shaft system 10 may be used by club fitters to repeatedly change shaft 12 and club head 16 combinations during a fitting session. The system permits fitting accounts maximum fitting options with an assembly of parts that is easy to use. In an embodiment, after a desired shaft 12 and club head 16 combination is selected, interchangeable shaft system 10 may be semi-permanently fixed so that disassembly by the average consumer is prevented. Alternatively, interchangeable shaft system 10 may be configured so that a consumer may manipulate the connection to replace shaft 12 or club head 16 and/or to provide adjustability between shaft 12 and club head 16.

As illustrated, the interchangeable shaft system of the present invention is incorporated into a driver style golf club. However it should be appreciated that the interchangeable shaft system of the present invention may be incorporated into any style of golf club. For example, the interchangeable shaft system may be incorporated into putters, wedges, irons, hybrids and/or fairway wood styles of golf clubs.

Club head 16 generally includes a face 24, a crown 25, a sole 26 and a skirt 27 that are combined to form the generally hollow club head 16. Club head 16 also includes hosel 20 that is a structure providing for a secure attachment between shaft 12 and club head 16 during manufacture of the golf club.

Shaft 12 may be any shaft known in the art. For example, shaft 12 may be constructed of metallic and/or non-metallic materials and shaft may be hollow, solid or a combination of solid and hollow portions.

Referring to FIGS. 1-5, interchangeable shaft system 10 connects shaft 12 to club head 16 so that different shafts 12 can be selectively connected to different club heads 16 via a hosel sleeve interface. Interchangeable shaft system 10 generally includes shaft sleeve 14 that is coupled to shaft 12 and at least partially received within hosel 20 of club head 16 and fastener 18 that releasably couples sleeve 14 to club head 16.

In the assembled interchangeable shaft system 10, a distal end portion 34 of shaft 12 is received within a shaft bore 36 of sleeve 14 and is securely attached thereto. Shaft 12 may be securely attached to sleeve 14 using any fastening method. For example, attachment methods such as welding, ultrasonic welding, brazing, soldering, bonding, mechanical fasteners, etc., may be employed. Adhesives such as epoxies or other similar materials may be utilized to securely fasten shaft 12 and sleeve 14. Preferably, end portion 34 is bonded within shaft bore 36 using an adhesive, such as epoxy. Alternatively, the features of shaft sleeve, such as a threaded portion and the alignment features may be incorporated into the construction or co-molded with the shaft.

Sleeve 14 is inserted into hosel 20 in a selected orientation that assures that alignment features included on sleeve 14 and hosel 20 are engaged when the interchangeable shaft system is assembled. The orientation of the alignment features provides a desired relative position between shaft 12 and club head 16. Additionally, the engagement of the alignment features provides an anti-rotation feature that prevents relative rotation between sleeve 14 and hosel 20 about the longitudinal axis of hosel 20.

Hosel 20 is a generally tubular member that extends through crown 25 and at least a portion of club head 16. Hosel 20 defines a sleeve bore 30 that has a diameter selected so that a distal portion of sleeve 14 may be slidably received therein. Preferably, the diameter of sleeve bore 30 is selected so that there is minimal clearance between distal portion of sleeve 14 and hosel 20 to prevent relative lateral motion between sleeve 14 and hosel 20. Sleeve bore 30 terminates at a distal flange 31 which is located at a distal end of hosel 20. It should be appreciated, however, that the flange may be located at any intermediate position between the proximal and distal ends of the hosel.

In the present embodiment, a proximal end 28 of hosel 20 is disposed outward from club head 16 at a location spaced from crown 25 and includes at least one hosel alignment feature that extends through at least a portion of the sidewall of hosel 20. The hosel alignment feature provides at least one discrete alignment orientation between club head 16 and shaft 12 in the assembled golf club. In the present embodiment, hosel 20 includes alignment features in the form of a pair of notches 32 and each notch 32 extends through the sidewall of hosel 20 adjacent proximal end 28, i.e., each notch 32 extends from sleeve bore 30 to the outer surface of proximal end 28 of hosel 20.

Figure 6:
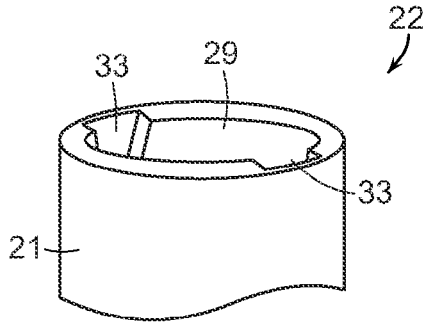
FIG. 6 is a perspective view of another embodiment of a proximal end portion of a hosel of a golf club having an interchangeable shaft system.

It should be appreciated that the hosel alignment feature need not extend entirely through the sidewall of the hosel and may extend through only a portion of the sidewall, as shown in the embodiment illustrated in FIG. 6. In particular, a proximal end portion 22 of a hosel 21 may include notches 33 that extend only through a portion of the sidewall of hosel 21. For example, notches 33 of the present embodiment include a generally trapezoidal cross-section similar to the previously described embodiment, however, notches 33 extend radially from sleeve bore 29 through a portion of the sidewall of proximal portion 22 of hosel 21 and do not intersect the outer surface of hosel 21. Such an embodiment may be preferred when it is desired to hide the alignment features from a user.

Notches 32 are diametrically opposed from each other in proximal end 28 at spaced locations about the proximal end of the generally tubular hosel 20. That configuration allows the combined shaft 12 and sleeve 14 to be coupled to club head 16 in two discrete positions rotated approximately 180° from each other. However, the hosel alignment features may be located in any desired position adjacent proximal end 28 of hosel 20 to provide any desired orientation between sleeve 14 and hosel 20. Although the present invention includes a pair of hosel alignment features, any number of hosel alignment features may be provided to provide any number of discrete orientations between shaft 12 and club head 16. Still further, a single hosel alignment feature may be provided when a single discrete orientation between the shaft and club head is desired.

Sleeve 14 includes a distal body 38, a proximal ferrule 40 and at least one sleeve alignment feature. The present embodiment includes a pair of sleeve alignment features (e.g., tangs 42). Body 38 is generally cylindrical and includes a proximal end that is coupled to a distal end of ferrule 40. The length of shaft sleeve 14 and the diameter of shaft 12 may be selected so that adequate surface area is provided for attachment to shaft 12. Shaft sleeve 14 and shaft 12 are configured to provide approximately 0.5-2.0 $in^2$ of bonding surface area. In an embodiment, shaft sleeve 14 and shaft are selected to provide approximately 1.2 $in^2$ of bonding surface area. In particular, in that embodiment, shaft sleeve 14 has a bonding length of approximately 1.1 inches to provide adequate bonding surface area on a shaft having a 0.335 inch diameter. In the present embodiment, body 38 and ferrule 40 are coupled so that they form a single integrated component, but it should be appreciated that body 38 and ferrule 40 may be separate components.

Tangs 42 extend laterally outward beyond an outer surface of body 38 adjacent the interface between body 38 and ferrule 40. The shape of tangs 42 is selected to complement the shape of notches 32 so that relative rotation about the longitudinal axis of hosel 20 in either direction between sleeve 14 and hosel 20 is prevented when tangs 42 engage notches 32. For example, tangs 42 have a generally trapezoidal cross-sectional shape and that trapezoidal shape is selected to complement and engage the trapezoidal shape of notches 32. Tangs 42 are configured so that they are tapered with the narrowest portion oriented toward the distal end of sleeve 14 and notches 32 are similarly tapered with the narrowest portion oriented toward sole 26 of club head 16. Additionally, the outer surfaces of tangs 42 are curved with a diameter that is substantially identical to the outer diameter of proximal end 28 of hosel 20 so that the outer surface of tangs 42 are substantially flush with the outer surface of hosel 20 in an assembled golf club. However, it should be appreciated that the outer surface of the tangs and the proximal end of the hosel need not be flush if desired.

The complementary shapes of notches 32 and tangs 42 assure that there is a secure fit between sleeve 14 and hosel 20 when interchangeable shaft system 10 is assembled. In particular, as sleeve 14 is inserted into sleeve bore 30 of hosel 20, the tapered side edges of tangs 42 forcibly abut the tapered side walls of notches 32 to provide a secure fit that assures consistent and repeatable positioning of sleeve 14 relative to hosel 20. The tapered surfaces also prevent rotational play between sleeve 14 and hosel 20 resulting from manufacturing tolerances or wear. Alternatively, the hosel and sleeve alignment features may have curved edges and side walls that engage during assembly to provide a similarly secure fit.

In the present embodiment, the outer diameter of body 38 is smaller than the outer diameter of the distal end of ferrule 40 so that a shoulder 46 is created at the interface between body 38 and ferrule 40. During assembly, body portion 38 of sleeve is inserted into sleeve bore 30 until shoulder 46 is disposed adjacent the top edge of hosel 20. The size, taper and/or curvature of the hosel and sleeve alignment features (e.g., tangs 42 and notches 32) are preferably selected so that there is a small amount of clearance between shoulder 46 and hosel 20 when the golf club is assembled. Additionally, with respect to the present embodiment, the size and taper of tangs 42 and notches 32 are selected so that there is a small amount of clearance between the distal end surfaces of tangs 42 and the distal end surfaces of notches 32. That clearance allows the relative position between sleeve 14 and hosel 20 to be easily controlled by manipulating the dimensions of the respective alignment features. Preferably, the amount of clearance between shoulder 46 and hosel 20 is visually imperceptible, or at least not easily noticeable, in the assembled golf club. For example, the amount of clearance may range from 0.005-0.030 inches.

Sleeve 14 and hosel 20 may be constructed from any metallic or non-metallic material, such as, for example, titanium, steel, aluminum, nylon, fiber reinforced polymer or polycarbonate. Furthermore, sleeve 14 and hosel 20 may be constructed from the same or different materials and as discussed further below each of sleeve 14 and hosel 20 may alternatively have multi-material construction. Additionally, sleeve 14 and/or hosel 20 may be constructed from a material that is a combination of both metallic and non-metallic material, such as a polymer infused or plated with metallic material. In an embodiment, hosel 20 is constructed of titanium and sleeve 14 is constructed from aluminum. Preferably, hosel 20 is formed as an integral part of club head 16.

A coating or surface treatment may also be provided on sleeve 14 and/or hosel 20 to prevent corrosion and/or to provide a desired aesthetic appearance and/or to provide additional structural properties. For example, in embodiments utilizing sleeve 14 constructed from a first metallic material, such as aluminum, and hosel 20 constructed from a second metallic material, such as titanium, sleeve 14 may be anodized to prevent galvanic corrosion. As a further example, a non-metallic sleeve 14 may be coated with nickel to provide the appearance of metallic construction and/or to provide additional strength. The coating may be selected to provide any desired characteristic, for example, to improve strength the coating may be a metallic coating, such as a nickel alloy, having a nanocrystalline grain structure.

Sleeve 14 is securely fastened to club head 16 by fastener 18 to prevent disengagement of sleeve 14 from sleeve bore 30. Fastener 18 is primarily employed to prevent relative motion between sleeve 14 and club head 16 in a direction parallel to the longitudinal axis of hosel 20 by introducing an axial compressive force. Fastener 18 may be any type of fastener that restricts relative motion between sleeve 14 and hosel 20. For example, and as shown in the present embodiment, fastener 18 is an elongate mechanical fastener, such as a machine screw that engages a threaded hole in sleeve 14. Fastener 18 and sleeve 14 are dimensioned to provide sufficient thread length to withstand the axial forces placed upon interchangeable shaft system 10. In one exemplary embodiment, fastener 18 and sleeve 14 are dimensioned to provide ¼ inch of threaded engagement. Additionally, thread inserts may be provided if desired to increase the strength of the threads. For example, a thread insert such as Heli-coil thread inserts (a registered trademark of Emhart, Inc. of Newark, Del.) may be installed into sleeve 14.

Figure 3:
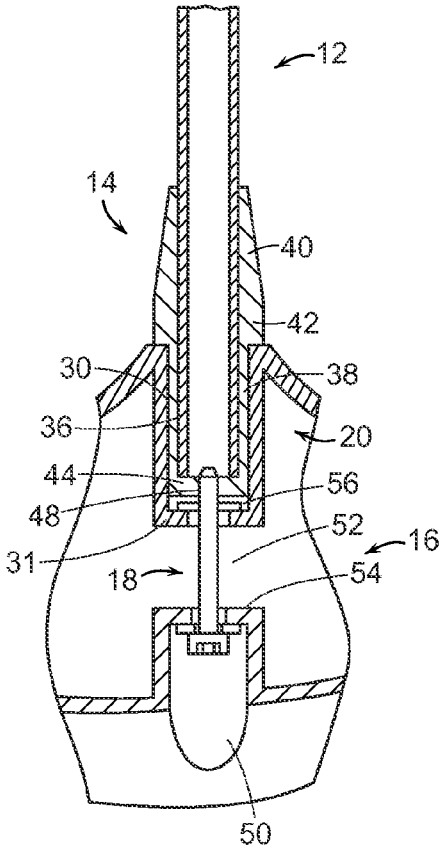
FIG. 3 is a cross-sectional view taken along line 3-3, shown in FIG. 1, of the golf club.
Figure 2:
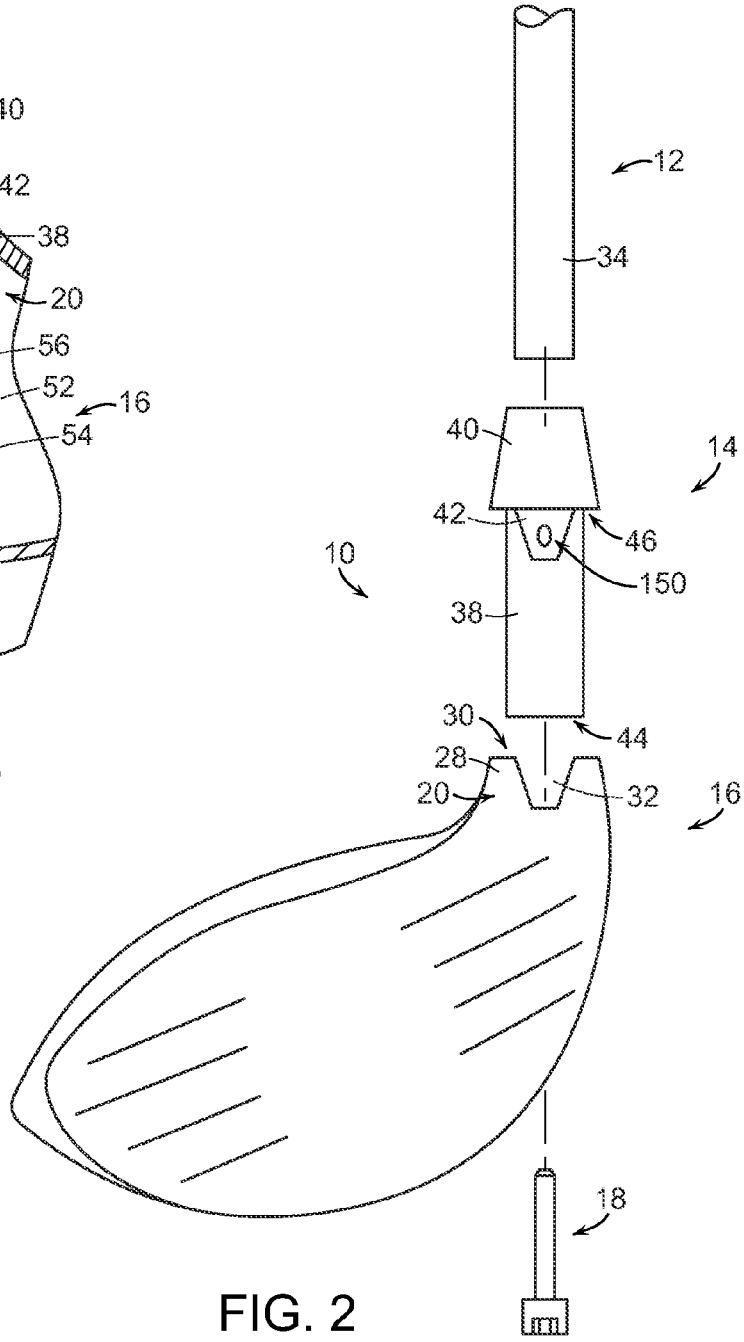
FIG. 2 is an exploded view of the golf club of FIG. 1.
Figure 4:
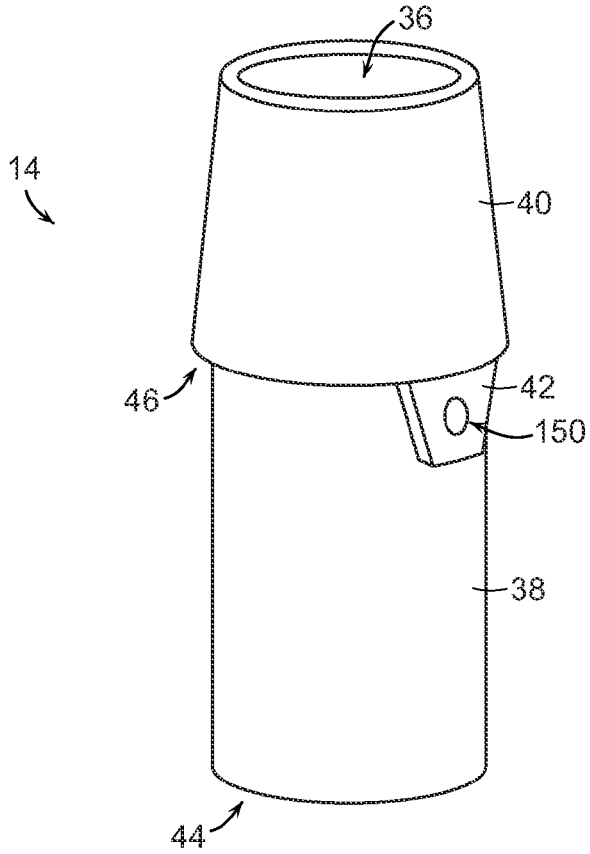
FIG. 4 is a perspective view of a shaft sleeve of the interchangeable shaft system.
Figure 5:
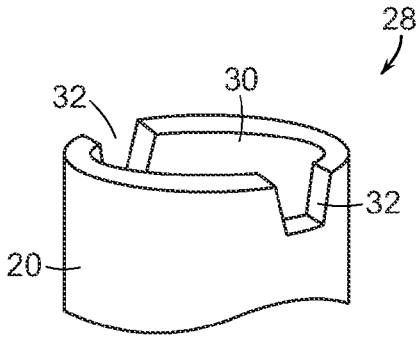
FIG. 5 is a perspective view of a proximal end portion of the hosel of the golf club of FIG. 1.

As shown in FIG. 3, hosel 20 extends only partially through club head 16. A separate fastener bore 50 is provided that extends into club head 16 proximally from sole 26 and is generally coaxially aligned with hosel 20. The proximal end of fastener bore 50 terminates at a proximal flange 54. Flange 54 is generally annular and provides a bearing surface for a head portion of fastener 18. A shank of fastener 18 extends through flange 54, across a gap 52 between fastener bore 50 and hosel 20, through flange 31 and engages flange 44 of sleeve 14.

During assembly, as fastener 18 is tightened, sleeve 14 is drawn into hosel 20. Simultaneously, tangs 42 of sleeve 14 are drawn into notches 32 of hosel 20 and the tapered side edges of tangs 42 forcibly abut the tapered side walls of notches 32. The tapered interface between tangs 42 and notches 32 assures that as fastener 18 is tightened in sleeve 14, the fit between sleeve 14 and hosel 20 becomes progressively more secure and sleeve 14 travels to a predetermined and repeatable position within hosel 20.

The depth of hosel 20 and sleeve bore 30 in club head 16 may be selected so that a desired length of shaft 12 and sleeve 14 are received therein. In the present embodiment, hosel 20 extends only partially into club head 16. It should, however, be appreciated that the hosel may extend through the entire club head so that it intersects the sole, as shown in the golf club of FIG. 22. In such embodiments, a flange providing a bearing surface for the head of the fastener may be located at any intermediate location within the hosel and a separate fastener bore need not be provided.

As previously described, the hosel alignment features are located adjacent proximal end 28 of hosel 20 and extend through at least a portion of the side wall of hosel 20. Locating the hosel alignment features adjacent proximal end 28 of hosel 20 greatly simplifies manufacture of the hosel alignment features and club head 16 because the area is easily accessible. In particular, alignment features having precise tolerances may be incorporated into hosel 20 by simple machining processes and using common tools. For example, a generally trapezoidal hosel alignment feature extending entirely through the sidewall of hosel 20, such as notch 32, may be machined using a tapered end mill that is passed diametrically across proximal end 28 of a cast club head 16. As a result of that location, hosel alignment features having tightly controlled dimensions may be easily constructed with any desired shape by using simple tooling and processes.

The alignment features may be positioned at any location around the circumference of sleeve 14 and hosel 20. Preferably, a pair of alignment features are disposed approximately 180° apart about the circumference of body 38 and hosel 20 (i.e., the alignment features are diametrically opposed) with one of the features being located adjacent face 24 of club head 16. That orientation results in the alignment features being obscured from sight when a user places the club in the address position and views the club along a line of sight that is generally parallel to the longitudinal axis of shaft 12. That orientation also allows the alignment features to be easily viewed by a user during adjustment by viewing club head 16 along a line of sight that is generally normal to face 24.

As an additional feature, a locking mechanism may be provided to prevent fastener 18 from disengaging from sleeve 14. Any locking mechanism may be employed. For example, lock washers may be provided between the head of fastener 18 and the adjacent bearing surface. As a further alternative, a locking thread design, such as a Spiralock locking internal thread form (a registered trademark of Detroit Tool Industries Corp. of Madison Heights, Mich.) may be incorporated into threaded bore 48 of flange 44. As a still further alternative, a thread locking material, such as Loctite thread locking adhesive (a registered trademark of the Henkel Corp. of Gulph Mills, Pa.) may be applied to fastener 18 or threaded bore 48. Still further, fastener 18 may be provided with a locking feature such as a patch lock. Additionally, a bonding material, such as epoxy may be applied to the head of fastener 18 at an interface with club head 16 after assembly.

As a still further feature, a retainer 56 may be employed so that fastener 18 is retained within club head 16 when it is not engaged with sleeve 14. During replacement of shaft 12 it is desired that fastener 18 is retained within club head 16 so that it is not misplaced. Retainer 56 is coupled to the shank of fastener 18 and located so that a flange is interposed between retainer 56 and the head of fastener 18. Retainer 56 is sized so that it is not able to pass through the through hole of the respective flange. Retainer 56 may be a clip that is frictionally coupled to the shank of fastener 18 adjacent flange 31 of hosel 20 located so that flange 31 is interposed between retainer 56 and the head of fastener 18.

Figure 7:
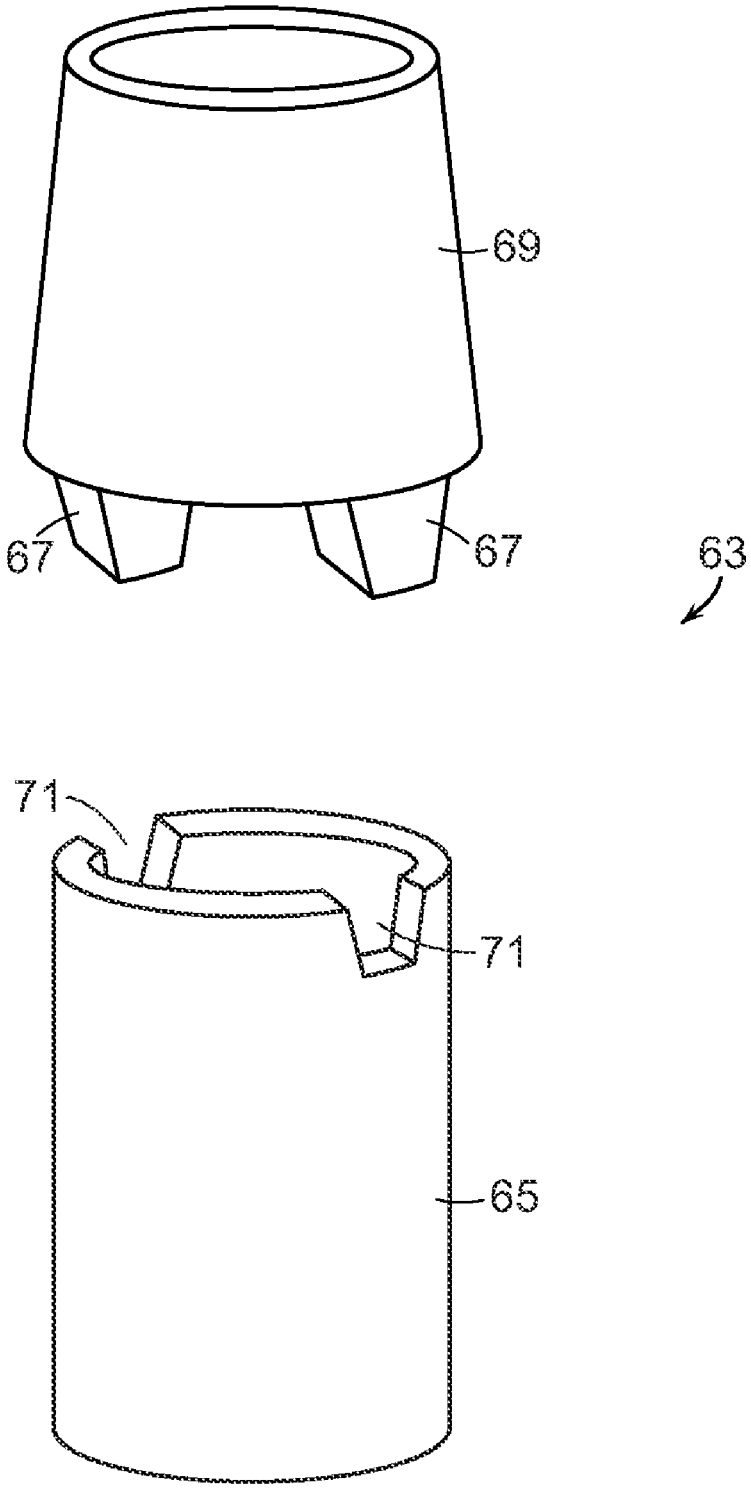
FIG. 7 is a perspective view of another embodiment of the shaft sleeve of the interchangeable shaft system.
Figure 8:
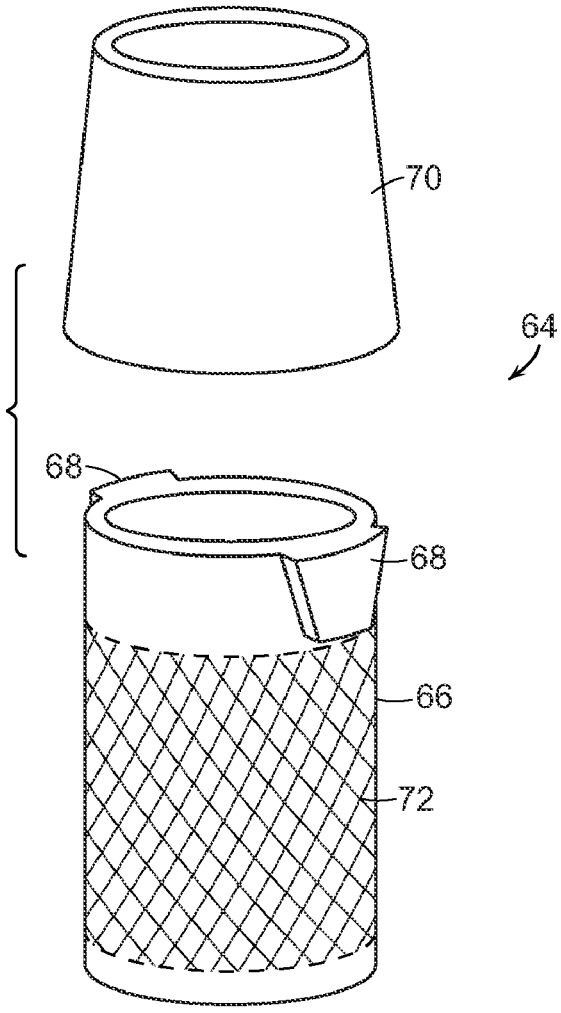
FIG. 8 is a perspective view of another embodiment of the shaft sleeve of the interchangeable shaft system.

Referring to FIGS. 7 and 8 embodiments of a multi-piece shaft sleeve will be described that may be substituted for shaft sleeve 14 in the previously described interchangeable shaft system. The multi-piece embodiments provide a configuration that allows for the use of alternative machining processes as compared to a single piece, machined or molded shaft sleeve. Additionally, it provides additional options for including multiple materials in a single shaft sleeve which may provide weight and/or manufacturing advantages. In an embodiment, shaft sleeve 63 includes a multi-piece construction that includes a body 65, a pair of alignment features (e.g., tangs 67) and a ferrule 69. In the present embodiment, tangs 67 are integral with ferrule 69, but body 65 is a separate component.

Body 65 is generally cylindrical and includes a proximal end that is located adjacent a distal end of ferrule 69 when assembled on a shaft. The proximal end of body 65 includes notches 71 that are sized and shaped to complement the size and shape of tangs 67. In particular, notches 71 are preferably sized and shaped so that there are no gaps between the distal surface of ferrule 69 and the proximal end surface of body 65 or between the side surfaces of tangs 67 and the side surfaces of notches 71. Additionally, the thickness of tangs 67 is selected so that when shaft sleeve 63 is assembled, portions of tangs 67 extend radially outward beyond the outer surface of body 65. As a result, that portion of tangs 67 extending radially outward from body 65 is available to engage engagement features provided in the proximal end portion of the hosel of a golf club head as described above.

Referring to FIG. 8, another alternative embodiment of the shaft sleeve will be described. Shaft sleeve 64 includes a body 66, a pair of alignment features (e.g., tangs 68) and a ferrule 70. Tangs 68 are integral with body 66 and ferrule 70 is separate from tangs 68 and body 66. Body 66 is generally cylindrical and includes a proximal end that is located adjacent a distal end of ferrule 70 when assembled on a shaft. Tangs 68 extend laterally outward from body 66 adjacent the proximal end of body 66.

Body 66 and ferrule 70 may be constructed from any materials and they may be constructed from the same or different materials. For example, body 66 may be machined from a metallic material, such as aluminum, and ferrule 70 may be molded or machined from a non-metallic material, such as nylon. Different materials may be used to provide weight savings over an entirely metallic sleeve while still providing adequate structural qualities and bonding surface area. Additionally, different materials may be selected to provide desired aesthetic properties.

The body of any embodiment of the shaft sleeve may further include weight reducing features if desired. For example, and as shown in FIG. 8, shaded portion 72 may include slots, depressions, through holes or any other feature that reduces the volume of material from which body 66 is constructed. The volume of body material may be reduced over any desired portion of the shaft sleeve body as long as sufficient surface area is provided for adequately coupling the shaft with the shaft sleeve.

Figure 9:
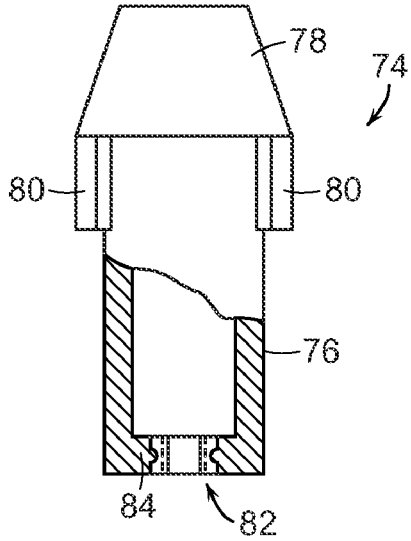
FIG. 9 is a partial cross-sectional view of another embodiment of the shaft sleeve of the interchangeable shaft system.

A further embodiment of the shaft sleeve is illustrated in FIG. 9. Similar to the previously described embodiments, shaft sleeve 74 includes a body 76, a ferrule 78 and tangs 80 extending laterally outward from body 76. Shaft sleeve 74 is illustrative of a single piece construction of the shaft sleeve that is molded from a non-metallic material, such as, for example, nylon, fiber reinforced polymer or polycarbonate. Because of that construction, shaft sleeve 74 also includes a threaded insert 82 that is molded into a distal flange 84 of sleeve 74. Threaded insert 82 may include features that allow the insert to be securely molded in place, such as knurling and/or one or more ribs or flanges.

Figure 10:
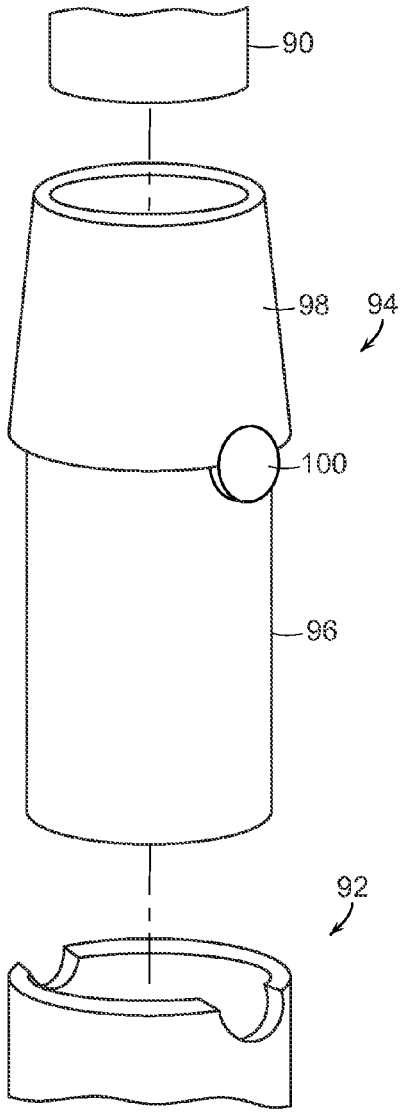
FIG. 10 is an exploded view of a golf club including another embodiment of the interchangeable shaft system of the present invention.

A still further embodiment of the shaft sleeve is shown in FIG. 10, which illustrates an exploded view of a portion of another embodiment of a golf club including an interchangeable shaft system. Similar to the previously described embodiments, the golf club includes a shaft 90 that is coupled to a hosel 92 of a club head by an interchangeable shaft system that includes a shaft sleeve 94.

In the present embodiment, sleeve 94 utilizes a multi-piece construction. Sleeve 94 includes body 96 that is integral with ferrule 98 and sleeve alignment features that are formed by a separate pin 100 that is coupled to body 96 and ferrule 98. Pin 100 extends diametrically across the interface of body 96 and ferrule 98 and is securely coupled to body 96 and ferrule 98. The length of pin 100 is selected so that the ends of pin 100 extend laterally outward beyond the outer surface of body 96. Preferably, each end of pin 100 extends laterally outward of body 96 by a distance corresponding to the thickness of the side wall of hosel 92 of the club head so that the ends of pin 100 are generally flush with the outer surface of hosel 92. Although pin 100 is illustrated as a generally cylindrical member, it should be appreciated that it may have any desired cross-sectional shape and hosel 92 may include hosel alignment features having any complementary shape. For example, pin 100 may be a key having any polygonal cross-sectional shape, such as a triangle, trapezoid, square, rectangle, diamond, etc.

The interchangeable shaft system of the present invention may be configured to provide adjustability for the angular attributes of an assembled golf club, including face angle, lie and loft. As described above, the configuration of the hosel and sleeve alignment features provide discreet orientations of the sleeve relative to the hosel. The shaft may be mounted to the sleeve so that the shaft is not coaxial with the sleeve. That misalignment allows each of the discreet orientations of the sleeve relative to the hosel to correspond to a different orientation of the shaft to the club head. For example, by mounting the shaft to the sleeve so that the longitudinal axis of the shaft is rotated relative to the shaft, the angular attributes of the assembled golf club may be adjustable by changing the orientation of the shaft sleeve relative to the hosel.

Figure 11:
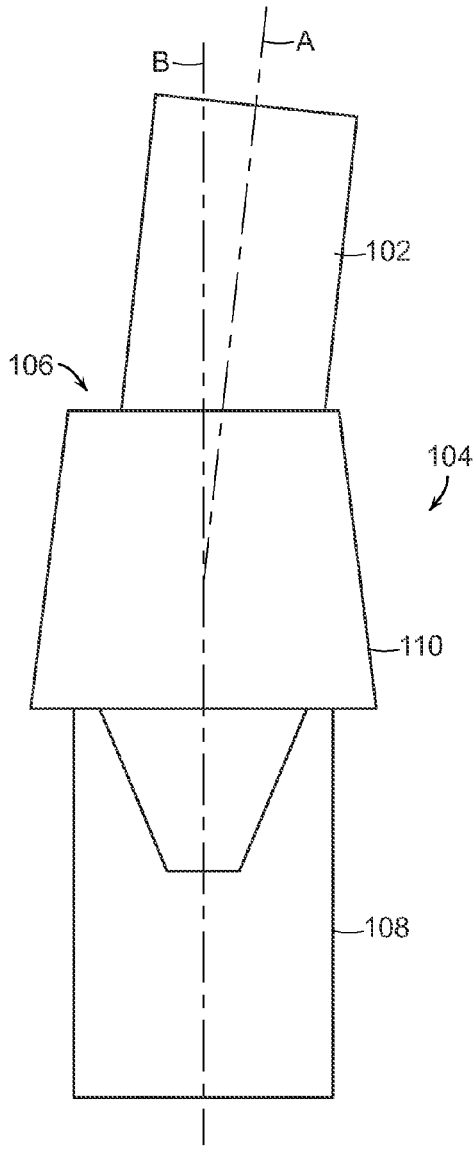
FIG. 11 is a schematic of the connection between a shaft sleeve and a shaft of the interchangeable shaft system.

As shown in FIG. 11, a shaft 102 is mounted to a sleeve 104 so that an angular attribute, or select combinations of angular attributes, may be adjusted between at least a first configuration and a second configuration. In particular, a longitudinal axis A of a shaft bore 106 of sleeve 104 may be rotated relative to a longitudinal axis B of a body 108 and a ferrule 110 of sleeve 104. As a result, when a shaft 102 is inserted into sleeve bore 106, the longitudinal axis of shaft 102 is coaxial with longitudinal axis A of sleeve bore 106. By rotating sleeve 104 approximately 180°, the orientation of shaft 102 relative to sleeve 104 changes from a positive to a negative angle relative to longitudinal axis B.

The direction of the rotational offset between axis A and axis B is positioned relative to the hosel and sleeve alignment features so that rotation of the sleeve within the hosel between the two positions alters the club face angle. In particular, the sleeve may be coupled to the hosel in a first position corresponding to a first configuration wherein the club face is opened. The sleeve may then be coupled to the hosel in a second position, e.g., the sleeve is rotated 180° from the first position, which corresponds to a second configuration wherein the club face is closed. It should be appreciated that shaft 102 and sleeve 104 may be coupled so that more than two configurations are provided. For example, the sleeve and accompanying golf club head may be configured so that there are more than two relative configurations thereby providing adjustability in multiple combinations of angular attributes.

Additionally, the depth of the hosel alignment features may be different and, as a result, a golf club including the interchangeable shaft system of the present invention may be adjustable for overall length by providing a plurality of hosel alignment features having different depths. For example, in an embodiment, a pair of hosel alignment features having different depths from the proximal end of the hosel are provided in a golf club head. A shaft sleeve is provided that includes a single sleeve alignment feature that is sized and shaped to engage either of the hosel alignment features. In a first configuration, the sleeve alignment feature is engaged with the deeper hosel alignment feature, which results in the sleeve being drawn into the hosel to a first depth and thereby providing a first overall golf club length. In a second configuration, the sleeve alignment feature is engaged with the shallower hosel alignment feature, which results in the sleeve being drawn into the hosel to a second depth that is less than the first depth and thereby providing a second overall golf club length that is less than the first.

Figure 12:
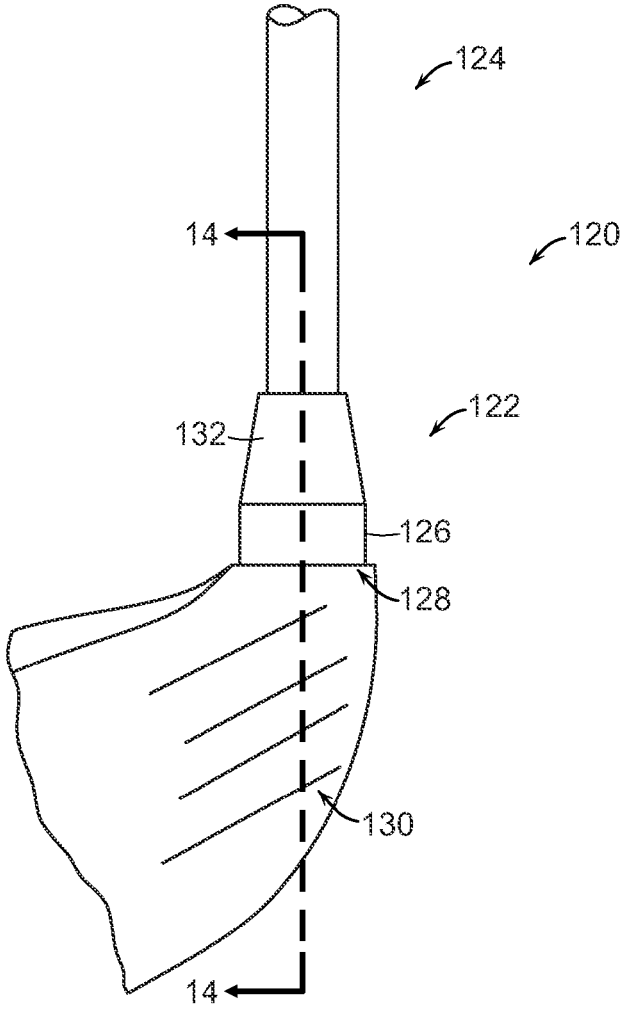
FIG. 12 is side view of a portion of a golf club including another embodiment of the interchangeable shaft system of the present invention.
Figure 13:
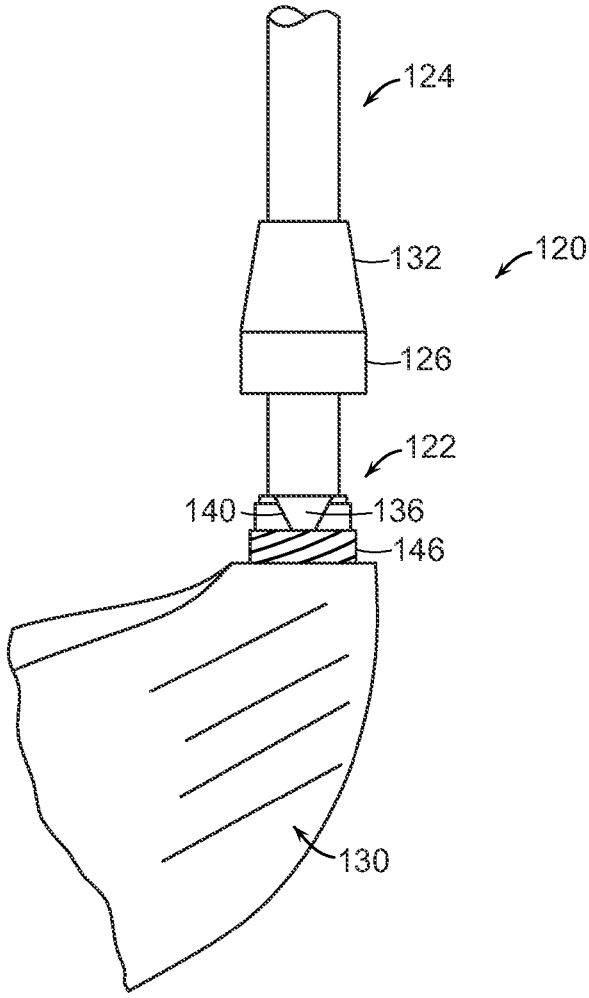
FIG. 13 is a partial exploded view of the golf club of FIG. 12.
Figure 14:
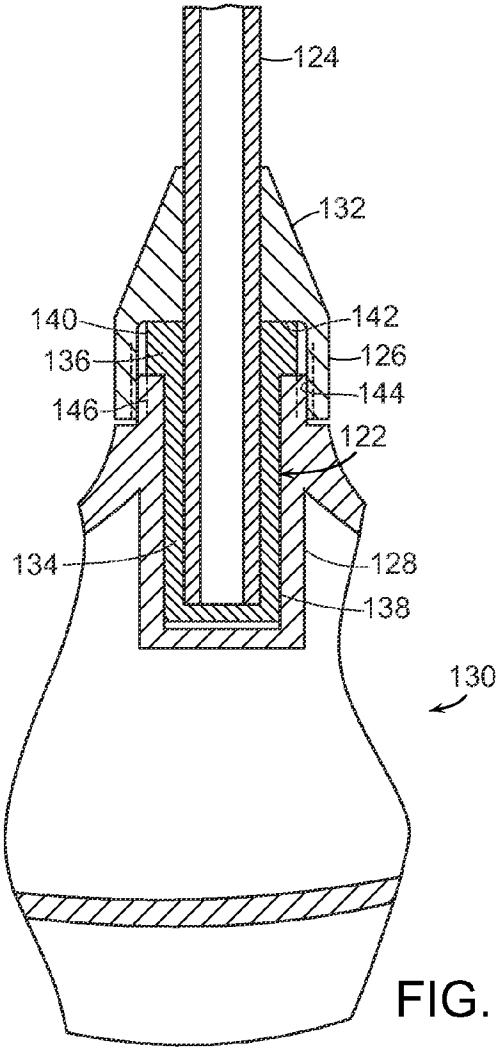
FIG. 14 is a cross-sectional view taken along line 14-14, shown in FIG. 12, of the golf club.

Referring to FIGS. 12-14, another embodiment of the interchangeable shaft system of the present invention will be described. Interchangeable shaft system 120 is similar to the previously described embodiments in that it generally includes a shaft sleeve 122 that is coupled to a shaft 124 and a fastener 126 that retains sleeve 122 within a hosel 128 of a club head 130. In the present embodiment, however, fastener 126 is integral with a ferrule 132.

Sleeve 122 includes a body 134 and alignment features (e.g., tangs 136). Sleeve 122 includes a separate ferrule 132. In the assembled golf club, body 134 of sleeve 122 is at least partially received within a sleeve bore 138 of hosel 128. Body 134 is oriented so that tangs 136 engage complementary alignment features of hosel 128 (e.g., notches 140).

Fastener 126 is integrated into and forms a portion of ferrule 132. In particular, fastener 126 is a distal portion of ferrule 132 that is configured to mechanically engage a portion of hosel 128. For example, fastener 126 is a portion of ferrule 132 that includes a threaded internal 144 surface and is configured to threadably engage a threaded outer surface 146 of hosel 128.

Ferrule 132 also includes a bearing surface 142. Bearing surface 142 forcibly abuts a proximal end surface of sleeve 122 when interchangeable shaft system 120 is assembled. During assembly, shaft 124 is inserted through ferrule 132 so that ferrule 132 is able to slide on and rotate relative to shaft 124. Next, sleeve 122 is coupled to the distal end of shaft 124. The dimensions of sleeve 122 are selected so that ferrule 132 is prevented from sliding past sleeve 122 toward the distal end of shaft 124. Sleeve 122 is then inserted into sleeve bore 138 so that tangs 136 engage notches 140 with sleeve 122 in a desired rotational orientation. Finally, ferrule 132 is slid along shaft 124 until bearing surface 142 abuts sleeve 122 and fastener 126 is threaded on hosel 128.

Indicia may be provided to clearly indicate the configuration of the shaft relative to the club head in the assembled golf club. For example, and as described above, the shaft may be coupled to the shaft sleeve so that the club can be assembled in a first or second configuration. Indicia may be placed on the shaft sleeve and/or the hosel to indicate the assembled configuration. The indicia may be positioned so that they are visible only during assembly or during and after assembly, as desired.

Referring to FIGS. 15-19, any form of indicia may be provided. The indicia may be engraved, raised, printed and/or painted and they may be one or more letters, numbers, symbols, dots and/or other markings that differentiate the available configurations of the golf club. The indicia may be included on any portion of the club head, shaft sleeve, or shaft of the assembled golf club. Preferably, indicia are provided on or adjacent the sleeve and/or hosel alignment features.

Figure 16:
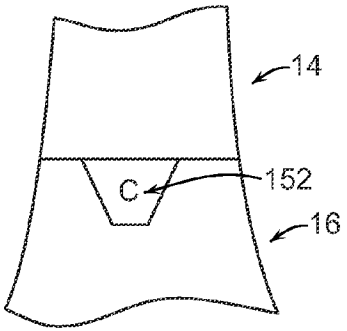
FIGS. 15-19 are side views of various indicia that may be incorporated into a golf club including the interchangeable shaft system of the present invention.
Figure 15:
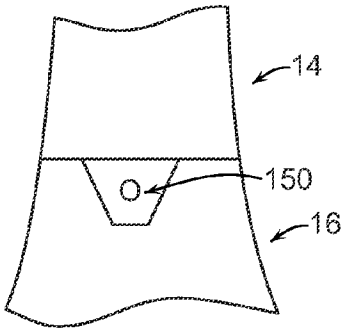

As shown in FIGS. 1, 15 and 16, the indicia may include letters corresponding to the configuration of the golf club. In an embodiment, indicium 150 is an "O" that is located on a sleeve alignment feature and corresponds to an opened face angle configuration of the golf club. Additionally, indicium 152, in the form of a letter "C," is provided on another sleeve alignment feature that corresponds to a closed face angle club configuration.

As shown in FIG. 1, the hosel and shaft sleeve alignment features (e.g., notches 32 and tangs 42) and/or indicia are positioned to reduce the visibility of those features during use. In particular, in the assembled golf club, tangs 42 are located so that they are diametrically opposed from each other about the circumference of hosel 20 on an axis that is generally normal to a plane defined by face 24 of club head 16. As a result, tangs 42 are visible along a line of sight generally normal to face 24 of club head 16. However, when a user holds the club in the address position, the tangs 42 are obscured from view, i.e., the alignment features are not visible along an axis generally parallel to the longitudinal axis of the shaft, and the golf club has an appearance of a golf club lacking the interchangeable shaft system when the golf club head is at address.

Figure 18:
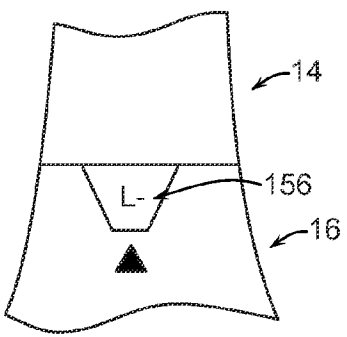
Figure 17:
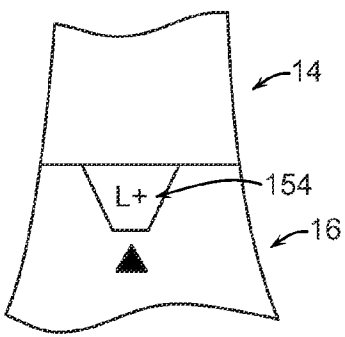

Additional examples of indicia are illustrated in FIGS. 17 and 18. In FIG. 17 indicia 154 and 156 include both letters and symbols (e.g., "L+" and "L−"). Combinations of letters, symbols and/or numbers may be used to clearly indicate the configuration of the assembled golf club. In the present example, indicia 154 and 156 are particularly well-suited to indicate increased and reduced lie or loft angle of the club head, respectively. Additionally, indicium may be provided to indicate to the user which of the indicia included on sleeve 14 corresponds to the assembled configuration of the golf club.

Figure 19:
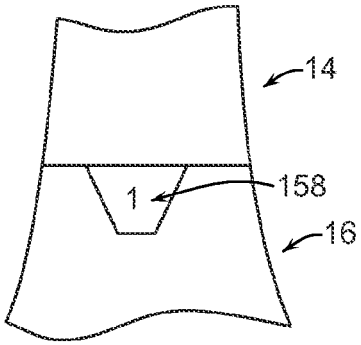

As a further example, indicium 158, shown in FIG. 19, may include numbers such as "0" and "1" or "1" and "2" to indicate the configuration of the components.

The interchangeable shaft system of the present invention provides advantages over conventional methods of club fitting. In a conventional fitting session a user is required to make test swings with a plurality of non-adjustable samples of a single golf club. For example, a conventional fitting cart, or bag, generally includes a plurality of sample 6-Irons having multiple configurations. The user is required to try many of those sample clubs to try to determine which sample includes the most appropriate configuration. However, because each sample club is not adjustable, differences between the individual components of the plurality of sample clubs introduce additional variables into the fitting process and the fitting cart, or bag, is required to include many separate and complete sample clubs.

A method of fitting golf clubs to a user utilizing the interchangeable shaft system of the present invention removes many of those additional variables and reduces the number of required complete sample clubs by minimizing the number of components required for the fitting process. The interchangeable shaft system allows a single club head to be used throughout the fitting process with different shafts and/or by altering the orientation of a single shaft relative to the club head. The system also allows different club heads to be utilized with a single shaft if desired.

The method includes providing a golf club including the interchangeable shaft system of the present invention in a first configuration. Next, the user swings the golf club while it is in the first configuration. The user's swing and the ball flight characteristics are analyzed and the interchangeable shaft system of the golf club is disassembled and re-assembled into a second configuration. The user then swings the golf club while it is in the second configuration and the user's swing and the ball flight characteristics are analyzed. These steps may be repeated with any number of golf club configurations. Finally, the proper club configuration for the user is determined based on the analyses of the user's swings.

During the re-assembly of the interchangeable shaft system into a second configuration, many different operations may be preformed. For example, the combined shaft and sleeve that was included in the golf club in the first configuration may be re-oriented relative to the club head to provide a change in one, or combinations, of the angular attributes of the golf club. Alternatively, the shaft and sleeve combination may be substituted and a different shaft and sleeve attached to the club head. A substitution of the shaft and sleeve combination may be desired to change angular attributes and/or any other physical attribute of the golf club, such as shaft flexibility, shaft length, grip style and feel, etc.

Figure 20:
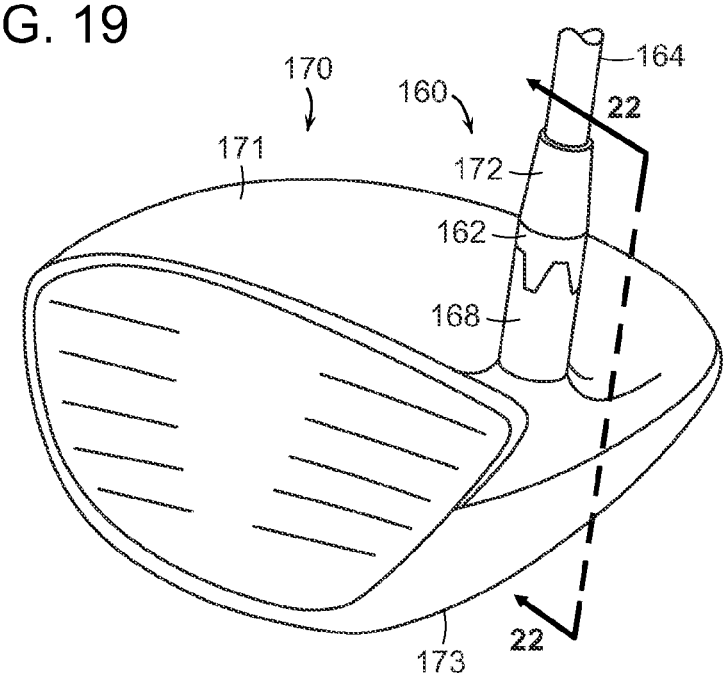
FIG. 20 is a perspective view of a portion of an exemplary golf club including an embodiment of the interchangeable shaft system of the present invention.
Figure 21:
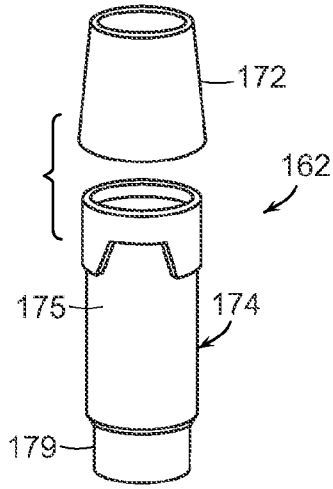
FIG. 21 is a perspective view of another embodiment of the shaft sleeve of the interchangeable shaft system.
Figure 22:
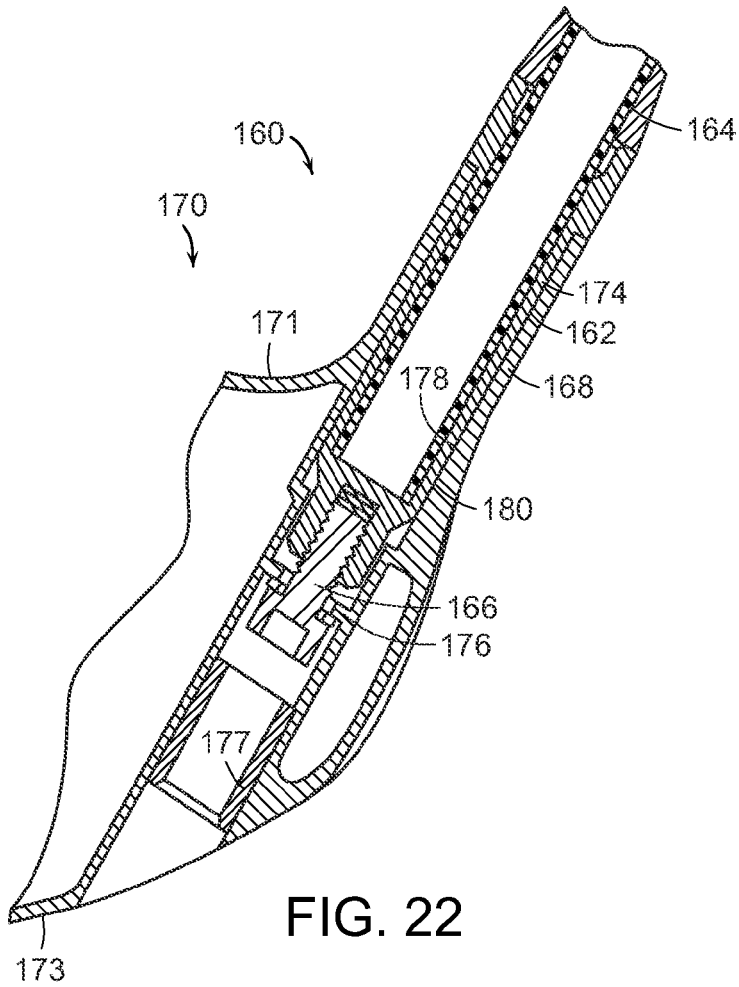
FIG. 22 is a cross-sectional view of a golf club including the interchangeable shaft system of the present invention.

Another embodiment of a golf club including an interchangeable shaft system of the present invention is illustrated in FIGS. 20-22. Interchangeable shaft system 160 generally includes a shaft sleeve 162 that is coupled to a shaft 164, and a fastener 166 that retains sleeve 162 within a hosel 168 of a club head 170. In the present embodiment, however, hosel 168 extends through the entire club head 170 so that it intersects both a crown 171 and a sole 173 of club head 170.

Sleeve 162 includes a body 174 and alignment features (e.g., tangs). Body 174 includes a shaft portion 175 and a fastener portion 179. Shaft portion 175 is generally tubular and defines a sleeve bore 178. Fastener portion 179 is generally cylindrical and has an outer diameter that is less than or equal to the outer dimension of shaft portion 175. Fastener portion 179 includes a threaded bore that engages fastener 166.

In the assembled golf club, body 174 of sleeve 162 is at least partially received within sleeve bore 178 of hosel 168. Body 174 is oriented so that alignment features of sleeve 162 engage complementary alignment features of hosel 168 (e.g., notches). Additionally, a ferrule 172 may be included that abuts the proximal end of shaft sleeve 162 to provide a tapered transition between shaft sleeve 162 and shaft 164.

Fastener 166 is an elongate mechanical fastener, such as a machine screw that engages a threaded hole in sleeve 162. Fastener 166 and sleeve 162 are dimensioned to provide sufficient thread engagement length to withstand the axial forces placed upon interchangeable shaft system 160.

A flange 176 is included within hosel 168 at an intermediate position along the length of hosel 168. Flange 176 is generally annular so that it includes a through hole that is sized so that the threaded shank of fastener 166 extends through the hole and so that the head of fastener 166 is prevented from passing through the through hole. Flange 176 provides a bearing surface for the head of fastener 166 when it is engaged with sleeve 162 so that fastener 166 may be placed in tension when tightened in the threaded bore of sleeve 162.

Interchangeable shaft system 160 also includes a retainer 177 to retain fastener 166 within hosel 168 of club head 170 when it is not engaged with sleeve 162 such as during replacement or orientation of the shaft. Retainer 177 is a tubular body that is slidably received within hosel 168 on the side of hosel 168 closest to sole 173 so that the head of fastener 166 is disposed between retainer 177 and flange 176. The inner diameter of retainer 177 is selected so that it is smaller than the outer diameter of the head of fastener 166 but larger than the outer dimension of a tool that is utilized to rotate fastener 166. Alternatively, the retainer may be a solid plug that is preferably removable so that the retainer may be removed to access fastener 166.

Figure 23:
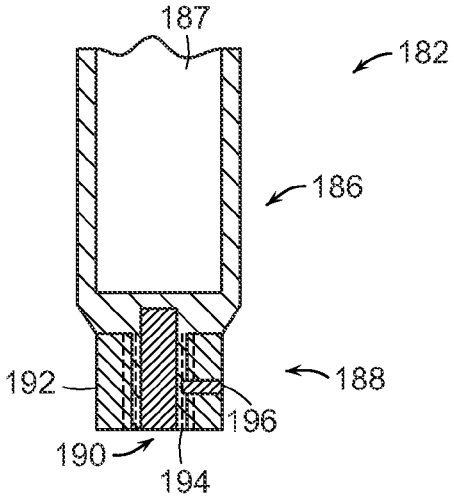
FIG. 23 is a cross-sectional view of a portion of an embodiment of a shaft sleeve.
Figure 24:
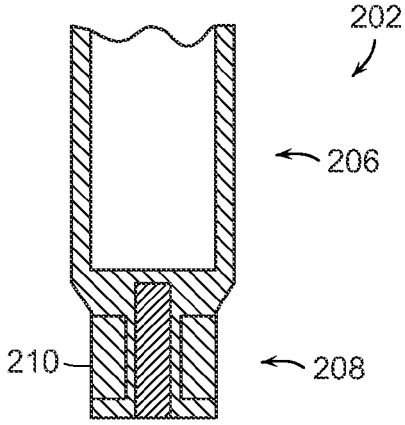
FIG. 24 is a cross-sectional view of a portion of another embodiment of a shaft sleeve.

Additionally, the swing weight of a golf club incorporating the interchangeable shaft system of the present invention may be altered using a sleeve having a desired weight. Referring to FIGS. 23 and 24. During assembly of a golf club, the club head is often weighted to compensate for manufacturing tolerances and/or to create a desired swing weight. In the present embodiment, shaft sleeve configurations having various weights may be provided so that they may be easily matched with the weights of the other components to provide the desired swing weight.

Referring to FIG. 23, a shaft sleeve 182 includes a body that has a shaft portion 186 and a fastener portion 188. Shaft portion 186 is generally tubular and defines a sleeve bore 187 that is sized to receive an end of a golf club shaft. Fastener portion 188 is generally cylindrical and has an outer diameter that is less than or equal to the outer dimension of shaft portion 186. Fastener portion 188 includes a threaded bore 190 extending into a post 194 that engages a fastener in an assembled interchangeable shaft system. In the present embodiment, fastener portion 188 also includes a weight 192 that is coupled to post 194. Weight 192 is generally configured to be removably coupled to post 194 so that weights 192 having different masses may be selectively attached to fastener portion 188. For example, weight 192 may be attached with a threaded interface between weight 192 and post 194 or weight 192 may be slidably engaged with post 194 and staked in place by a mechanical fastener 196 extending radially through weight 192, such as a set screw or pin. As a further alternative, weight 192 may be semi-permanently coupled to body 184, such as by applying an adhesive, or permanently attached, such as by welding, press-fitting or shrink-fitting.

Referring to FIG. 24, another embodiment of a shaft sleeve 202 will be described. Shaft sleeve 202 includes a body that has a shaft portion 206 and a fastener portion 208. Similar to the previously described embodiment, shaft portion 208 is configured to receive an end of a golf club shaft and fastener portion 208 is configured to engage a fastener in an assembled interchangeable shaft system. Fastener portion 208 includes a weight 210 that forms a part of fastener portion 208. In particular, weight 210 is a sleeve that is co-molded with fastener portion 208 of shaft sleeve 202 so that weight 210 is permanently coupled to shaft sleeve 202.

The materials and sizes of the weights of the embodiments described above are selected to provide a desired final weight of the shaft sleeve. Shaft sleeves having various weights may be constructed so that the shaft sleeve can be matched to the weight of a club head during assembly to provide a desired swing weight. The weights are generally constructed from a material that has a different density than the remainder of the shaft sleeve. For example, to add mass to an aluminum shaft sleeve a weight constructed of titanium, steel and/or tungsten may be employed. Additionally, a powder filled polymer, such as a tungsten filled thermoplastic may be employed. The mass of an aluminum shaft sleeve may be reduced by employing a weight constructed of a material having a lower density than aluminum such as polycarbonate or fiber reinforced plastic.

The embodiments of the present invention are illustrated with driver-type clubs. However, it should be understood that any type of golf club can utilize the inventive interchangeable shaft system. Additionally, the interchangeable shaft system can be used with non-golf equipment, such as fishing poles, aiming sights for firearms, plumbing, etc.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

We claim:

1. A shaft sleeve for attaching a golf club shaft to a golf club head, comprising:

a sleeve body defining a shaft portion configured to be coupled to a distal end of the shaft;

at least one sleeve alignment feature that extends from an outer surface of the sleeve body; and an annular member threadably coupled to the sleeve body, distal of the at least one sleeve alignment feature, such that a portion of the sleeve body extends through the annular member, wherein the annular member is captured on the sleeve body such that the annular member remains continually attached to the sleeve body from when the shaft sleeve is attached to the club head to when the shaft sleeve is separate from the club head.

2. The shaft sleeve of claim 1, wherein the sleeve alignment feature has a generally trapezoidal cross-sectional shape.

3. The shaft sleeve of claim 1, wherein the sleeve body includes a fastener portion configured to engage a fastener in an assembled golf club.

4. The shaft sleeve of claim 1, wherein the at least one sleeve alignment feature comprises a plurality of alignment features.

5. The shaft sleeve of claim 1, wherein the sleeve body is constructed of a first material and the annular member is constructed of a second material that is different than the first material.

6. A shaft sleeve for attaching a golf club shaft to a golf club head, comprising:

a sleeve body comprising a portion configured to receive a distal end portion of the shaft and a fastener portion, wherein the fastener portion includes a fastener bore;

at least one sleeve alignment feature extending from an outer surface of the sleeve body; and an annular member threadably coupled to the sleeve body;

wherein the annular member is coupled to the fastener portion, such that at least a portion of the fastener portion extends through at least a portion of the annular member in an assembled golf club, and such that the annular member is captured on the sleeve body when the sleeve shaft sleeve is separate from a club head.

7. The shaft sleeve of claim 6 wherein the sleeve alignment feature has a generally trapezoidal cross-sectional shape.

8. The shaft sleeve of claim 6 wherein the at least one sleeve alignment feature comprises a plurality of alignment features.

9. The shaft sleeve of claim 6 wherein the sleeve body is constructed of a first material and the annular member is constructed of a second material that is different than the first material.

* * * * *